US009870763B1

(12) United States Patent
Christian

(10) Patent No.: US 9,870,763 B1
(45) Date of Patent: Jan. 16, 2018

(54) COHERENCE BASED DYNAMIC STABILITY CONTROL SYSTEM

(71) Applicant: Harman International Industries, Inc., Stamford, CT (US)

(72) Inventor: Jonathan Wesley Christian, Milford, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/359,952

(22) Filed: Nov. 23, 2016

(51) Int. Cl.
*G10K 11/16* (2006.01)
*G10K 11/178* (2006.01)

(52) U.S. Cl.
CPC .. *G10K 11/1786* (2013.01); *G10K 2210/1282* (2013.01); *G10K 2210/3018* (2013.01); *G10K 2210/3026* (2013.01)

(58) Field of Classification Search
CPC ..... G10K 11/1786
See application file for complete search history.

(56) References Cited

U.S. PATENT DOCUMENTS

| | | | | |
|---|---|---|---|---|
| 9,318,092 | B2 * | 4/2016 | Hetherington | G10K 11/178 |
| 9,402,132 | B2 | 7/2016 | Park et al. | |
| 9,430,676 | B1 * | 8/2016 | Nickerson | G06F 21/75 |
| 2010/0033313 | A1 * | 2/2010 | Keady | G08G 1/0965 340/438 |
| 2014/0079244 | A1 * | 3/2014 | Vrazic | G10K 11/16 381/94.1 |
| 2015/0028549 | A1 | 1/2015 | Slater | |
| 2016/0275966 | A1 * | 9/2016 | Jazi | G10L 21/0208 |

FOREIGN PATENT DOCUMENTS

WO 2013107823 A1 7/2013

OTHER PUBLICATIONS

Otte et al., Operational Deflection Shapes in Multisource Environments, LMS International (1990), pp. 413-421, Belgium.
Sutton et al., Active Control of Road Noise Inside Vehicles, Institute of Noise Control Engineering (1994), pp. 137-147, United Kingdom.
Kuo et al., Active Noise Control: A Tutorial Review, Proceedings of the IEEE, vol. 87, No. 6 (1999), pp. 943-973, U.S.
Niettheim, The Estimation of Coherence, Office of Naval Research, Department of Statistics, Technical Report No. 5, Stanford University (1966), 80 pages, U.S.

* cited by examiner

*Primary Examiner* — Simon King
(74) *Attorney, Agent, or Firm* — Brooks Kushman, P.C.

(57) ABSTRACT

A coherence based dynamic stability control system for a vehicle audio system may include at least one output sensor configured to transmit an output signal including a noise cancellation signal and an undesired noise signal, and at least one input sensor configured to transmit an input signal indicative of an acceleration of a vehicle. A processor may be programmed to control a transducer to output the noise cancellation signal based on at least one parameter, receive the input signal and the output signal, determine a coherence between the input signal and the output signal. The processor may be further programmed to determine whether the coherence exceeds a predefined coherence threshold, adjust the at least one parameter to generate an adjusted parameter and control the transducer to output an updated noise cancellation signal based on the parameter in response to the coherence failing to exceed the predefined coherence threshold.

20 Claims, 5 Drawing Sheets

COHERENCE BASED DYNAMIC STABILITY CONTROL SYSTEM

TECHNICAL FIELD

Disclosed herein are coherence based stability controls systems.

BACKGROUND

Vehicles often generate structural-borne noise when driven. In an effort to cancel the noise, active noise cancellation is often used to negate such noise by emitting a sound wave having an amplitude similar to the amplitude as that of the road noise, but with an inverted phase. The effectiveness of such active noise cancellation is often dependent on the coherence between reference and feedback signals.

SUMMARY

A coherence based dynamic stability control system for a vehicle audio system may include at least one output sensor configured to transmit an output signal including a noise cancellation signal and an undesired noise signal, and at least one input sensor configured to transmit an input signal indicative of an acceleration of a vehicle. A processor may be programmed to control a transducer to output the noise cancellation signal based on at least one parameter, receive the input signal and the output signal, determine a coherence between the input signal and the output signal. The processor may be further programmed to determine whether the coherence exceeds a predefined coherence threshold, adjust the at least one parameter to generate an adjusted parameter and control the transducer to output an updated noise cancellation signal based on the parameter in response to the coherence failing to exceed the predefined coherence threshold.

A method for performing dynamic stability control for a vehicle audio system may include controlling a transducer to output a noise cancellation signal based on at least one default parameter and receiving at least one reference signal and feedback signal. The method may also include determining a coherence between the reference signal and feedback signal and determining whether the coherence exceeds a predefined coherence threshold. The method may include generating at least one updated parameter by dynamically adjusting the at least one default parameter; and providing an updated noise cancellation signal based on the at least one updated parameter in response to the coherence failing to exceed the predefined coherence threshold.

A coherence based dynamic stability control system for a vehicle audio system, may include a processor coupled to a transducer. The processor may be programmed to control the transducer to output a noise cancellation signal based on at least one default parameter and receive at least one reference signal and feedback signal. The processor may be further programmed to determine a coherence between the reference signal and feedback signal and determine whether the coherence exceeds a predefined coherence threshold. The processor may generate at least one updated parameter by dynamically adjusting the at least one default parameter, and providing an updated noise cancellation signal based on the at least one updated parameter in response to the coherence failing to exceed the predefined coherence threshold.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
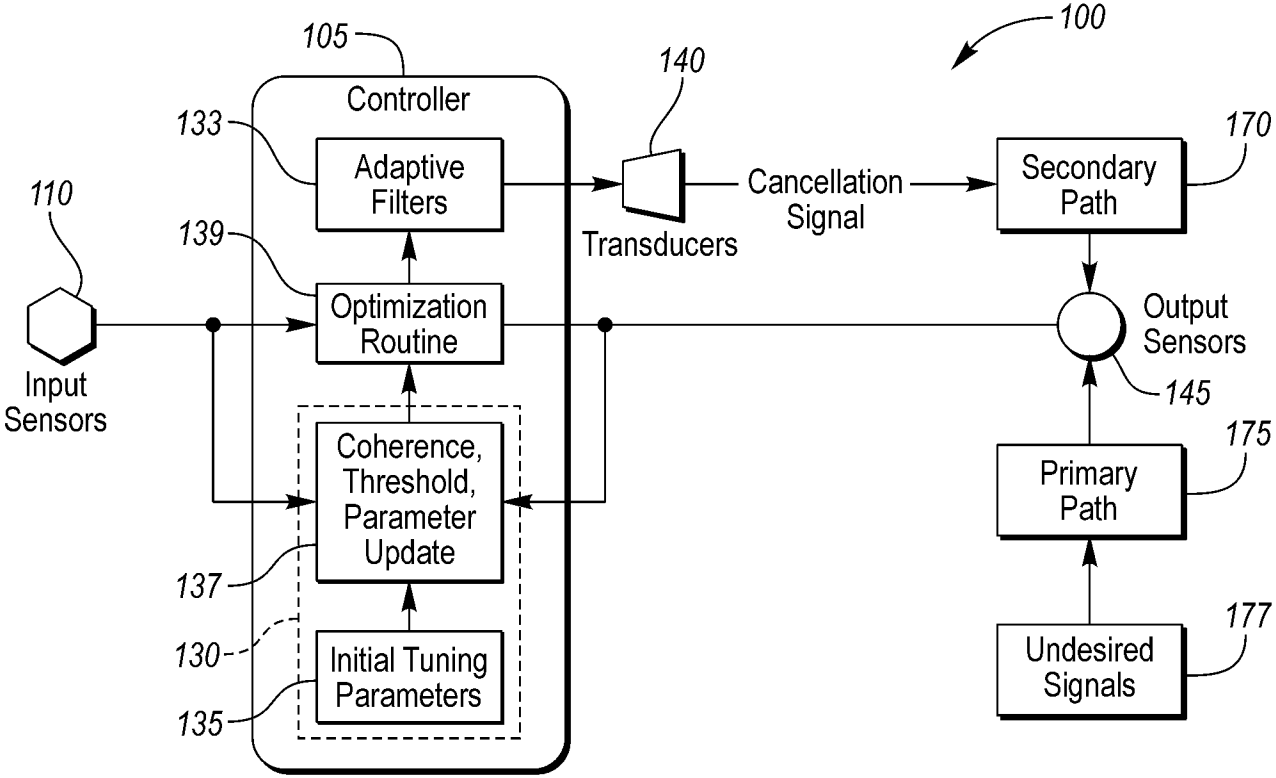
FIG. 1 illustrates an example coherence stability system in accordance with one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is a coherence stability control system for stabilizing the performance of narrowband and broadband noise cancellation systems. During noise cancellation in vehicles, filters are often used to reduce road noise and improve the listening experience within the vehicle cabin. The stability system, in addition to or in alternative to road noise, may also be applied to engine harmonic cancellation, airborne noises, aeroacoustics, fan, component level noise, etc. The performance of such noise cancellation is often dependent on coherent relationships. As windows are rolled down, a microphone may experience a large amount of aeroacoustic noise that will drive the coherence between two signals down. Such low coherence may affect the performance of the noise cancellation and result in instability and/or the loss of performance of the noise cancellation.

As coherence may be determined based on sensor data such as accelerometer data and/or microphone data and output channel data, the coherence may be used as part of the feedback loop to determine whether an instability exists. When the coherence drops, this condition indicates that there is instability at the audio system, such as a noise experienced at the microphone. For example, the microphone may be covered by an object, creating an erroneous noise not related to road noise. If the coherence drops below a certain threshold, the system may dynamically reduce the speaker output or shut off the speaker output completely. Additionally or alternatively, the system may cease using the output channel data in the filter update equations, thus, increasing performance regardless of the instability.

FIG. 1A illustrates an example coherence stability control system 100 having a controller 105, at least one input sensor 110, a database 130, and at least one transducer 140. The controller 105 may be a stand-alone device that include a combination of both hardware and software components and may include a processor configured to analyze and process audio signals. Specifically, the controller 105 may be configured to perform broadband and narrowband noise cancellation, as well as active road noise cancellation (ARNC), within a vehicle based on received data from the input sensor 110. The controller 105 may include various systems and components for achieving ARNC such as a database 130, adaptive filters 133, and a coherence optimization routine 139.

In one example, the optimization routine 139 of the controller 105 may perform a coherence calculation between the signals received from the input sensor 110 and an output sensor 145. The determined coherence may indicate cohesion or similarity between two or more signals. The higher the coherence, the more cohesive the signals. The lower the coherence, the less alike the signals are and the poorer the performance of the system 100 will be. Coherence may be used to determine whether a signal is unstable. If the coherence, or estimation thereof, falls below a coherence threshold, the controller 105 may then use the coherence calculation to dynamically adjust various parameters of the speaker outputs (e.g., the noise cancellation signal) to increase stability in the noise cancellation processes. This is described in more detail below.

Additionally or alternatively, the controller 105 may be in communication with an electronic database (not shown) located remote to the controller 105. The database 130 may electrically store data and parameters for the coherence stability control system 100 as well as other noise cancellation parameters, such as filter coefficients. Prior to any adjustments for noise cancellation, the controller 105 may apply default parameters, or initial settings and tuning parameters 135, to output channels of the controller 105. These initial parameters may also be maintained in the database 130. The database 130 may further electrically store speaker parameters or output channel parameters such as gains, fader settings, etc., as well as maintain coherence, thresholds, and updated parameters 137. The updated parameters 137 may include parameters that differ from the default parameters in that the updated parameters 137 have been adjusted based on a coherence value determined by the coherence optimization routine 139.

The input sensor 110 is configured to provide an input signal to the controller 105. The input sensor 110 may include an accelerometer configured to detect motion or acceleration and to provide an accelerometer signal to the controller 105. The acceleration signal may be indicative of a vehicle acceleration, engine acceleration, wheel acceleration, etc. The input sensor 110 may also include a microphone configured to detect noise.

At least one adaptive filter 133 may be included in the system 100 for providing a noise cancellation signal to a transducer 140. The adaptive filter 133 may modify a filter coefficient of a finite impulse response (FIR) filter or/and an infinite impulse response (IIR) filter to minimize a cost function for providing the noise cancellation signal. The filter 133 may dynamically adjust the filter coefficients based on the coherence between the input and output signals.

The transducer 140 may be configured to audibly generate an audio signal provided by the controller 105 at an output channel (not labeled). In one example, the transducer 140 may be included in a motor vehicle. The vehicle may include multiple speakers arranged throughout the vehicle in various locations such as the front right, front left, rear right, and rear left. The audio output at each transducer 140 may be controlled by the controller 105 and may be subject to noise cancellation, as well as other parameters affecting the output thereof. In one example, the fade settings may mute one or more speakers. In another example, the gain at one speaker may be greater than the others. These parameters may be in response to certain user defined settings and preferences (e.g., setting the fader), as well as preset audio processing effects. The transducer 140 may provide the noise cancellation signal to aid in the ARNC to increase the sound quality within the vehicle.

An output sensor 145 may be a microphone arranged on a secondary path 170 and may receive audio signals from the transducer 140. The output sensor 145 may be a microphone configured to transmit a microphone output signal to the controller 105. The microphone output signal may be configured as the feedback signal for purposes of noise cancellation. The output sensor 145 may be configured to detect an auto spectra of the output channel. The output sensor 145 may provide the microphone output signal including a power spectrum indicative of a distribution of power into frequency components. The microphone output signal may be used to determine the coherence at the coherence optimization routine 139. The output sensor 145 may also receive undesired noise from the vehicle such as the road noise, at a primary path 175, and the microphone output signal may include an undesired noise signal 177 in addition to the noise cancellation signal.

Figure 2:
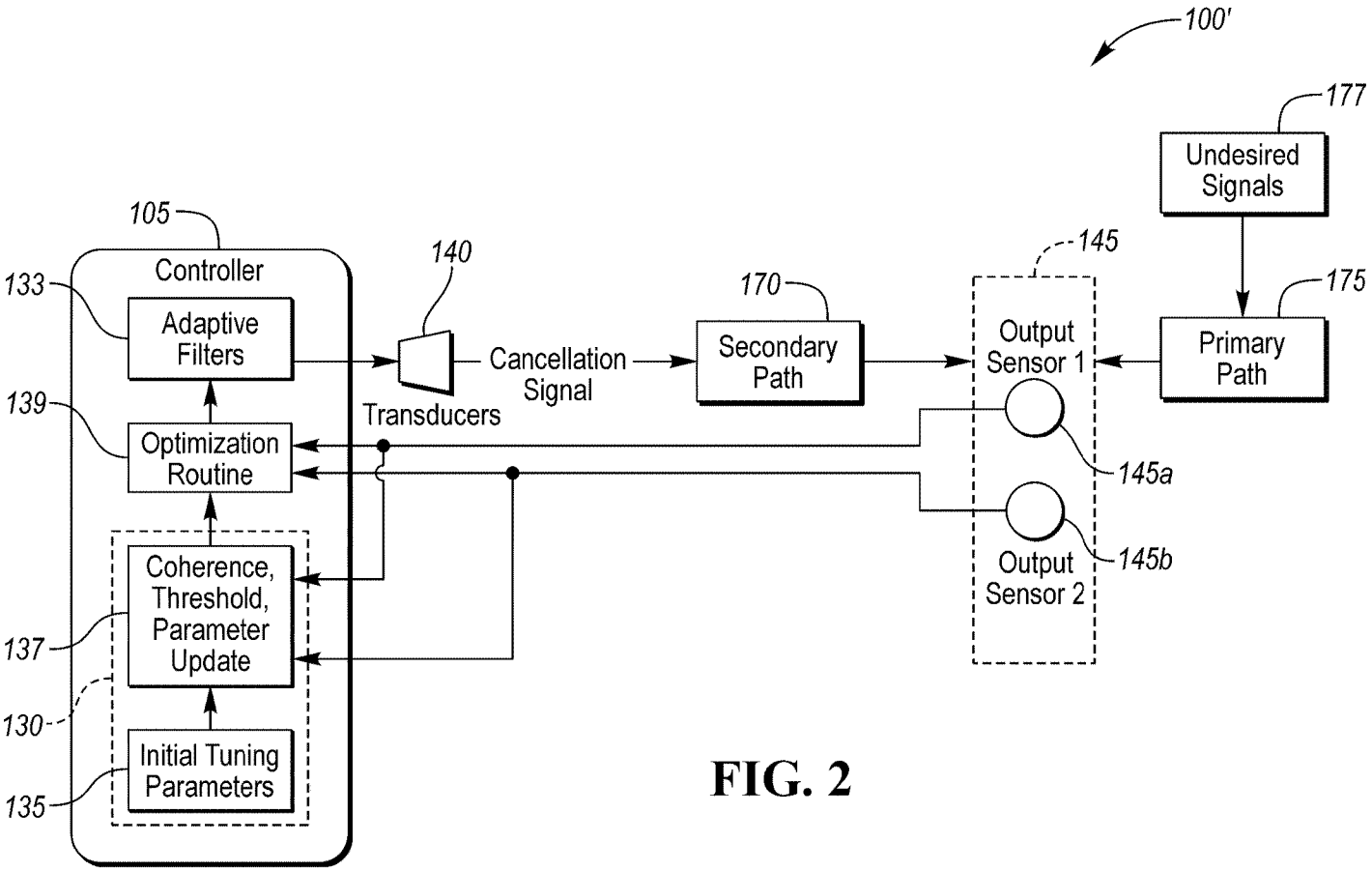
FIG. 2 illustrates another example coherence stability system.

FIG. 2 illustrates a implementation of example coherence stability control system 100' of FIG. 1 where the output sensor 145 includes a plurality of sensors 145*a*, 145*b*, as illustrated in FIG. 2. The first output sensor 145*a* and the second output sensor 145*b* may be microphones similar to output sensor 145 of FIG. 1. The example of FIG. 2 may represent a feedback system. Each output sensor 145*a*, 145*b* may receive audio signals with a power spectrum on the primary path 175 and transmit a microphone output signal to the controller 105 that is indicative of the power spectrum. The coherence may be calculated between the two output signals provided by the output sensors 145*a*, 145*b*.

Figure 3:
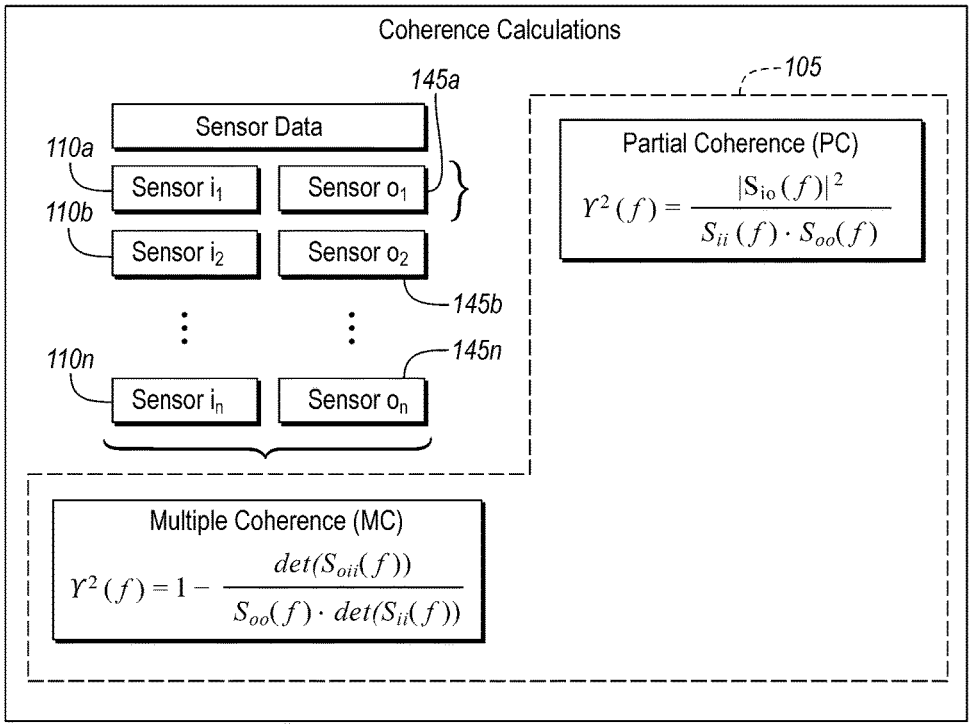
FIG. 3 illustrates an example block diagram for performing coherence calculations.

FIG. 3 illustrates an example block diagram for performing coherence calculations at the controller 105. The coherence calculations may be based on signals received from the input sensors 110 and the output sensors 145, as shown in FIG. 1. The coherence calculations may also be based on the signals received from the output sensors 145*a*, 145*b*, as shown in FIG. 2.

Partial coherence is often the coherence due to the signals identified with a particular source. In the case of partial or ordinary coherence, input signals from the first input sensor 110*a* and the first output sensor 145*a* may be used to determine the partial, or magnitude squared, coherence using the following equation:

$$\gamma^2(f) = \frac{|S_{io}(f)|^2}{S_{ii}(f) \cdot S_{oo}(f)} \qquad \text{Eq. 1}$$

where $S_{ii}$ is the auto spectra of the input channel from the first input sensor 110*a*, $S_{oo}$ is the auto spectra of the output channel of the first output sensor 145*a*, and $S_{io}$ is the cross spectra of the input and output channels.

In the case of multiple coherence (MC), signals from multiple sources, including signals from the inputs sensors 110 and the output sensors 145, may be used to determine the multiple coherence using the following equation:

$$\gamma^2(f) = 1 - \frac{\det(S_{oii}(f))}{S_{oo}(f) \cdot \det(S_{ii}(f))} \qquad \text{Eq. 2}$$

where $S_{ii}$ is the auto spectra of the input channels from the input sensors 110, $S_{oo}$ is the auto spectra of the output channels of the output sensors, $S_{io}$ is the cross spectra of the input and output channels, and $S_{oii}$ is the expanded matrix with the auto spectra $S_{oo}$, cross spectra $S_{oi}$, and the conjugates $S_{io}$. The determinant of the matrix of $S_{oii}(f)$ is taken over the product of $S_{oo}(f)$ and the determinant of the matrix of $S_{ii}(f)$.

The controller 105 may then use the coherence as a stability metric to determine whether system or tuning parameters should be adjusted to increase the performance of the noise cancellation. For example, if the coherence falls below a coherence threshold for a given frequency, the controller 105 may reduce the speaker output, or actually shut off the speaker output signals. The controller 105 may also remove, or stop using, the microphone output signal from the output sensor 145 in the noise cancellation equations. One example coherence threshold may be 0.71 which corresponds to a potential noise reduction of 3 dB. This is an example value and may be any value for adjusting the noise cancellation.

Figure 4A:
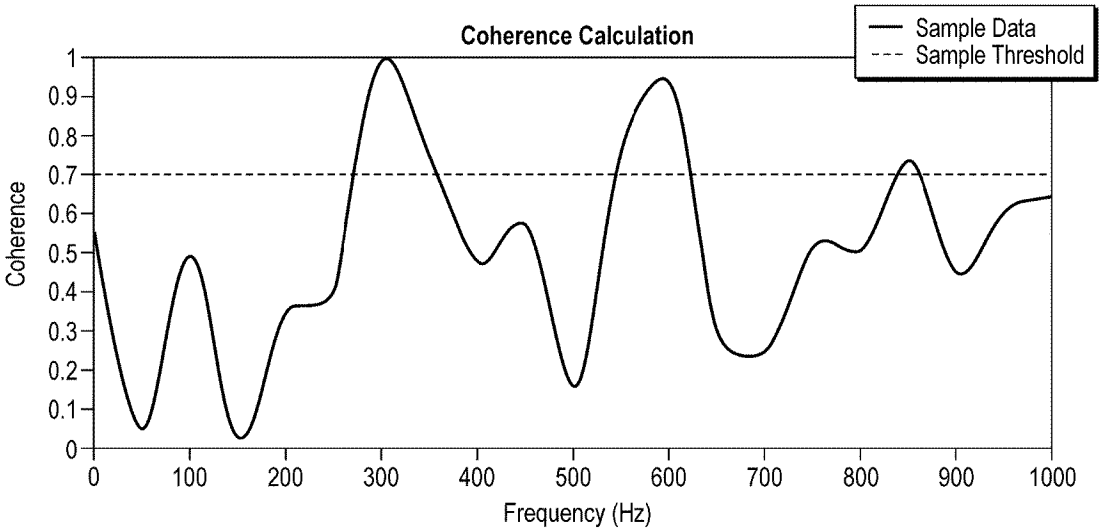
FIG. 4A illustrates an example chart of coherence over frequency.

FIG. 4A illustrates an example chart of coherence over frequency. FIG. 3A includes an example coherence threshold of 0.71. If the coherence, either partial or multiple, dips below a given threshold, the tuning parameters that contribute to the microphone output signal may be dynamically adjusted, or eventually muted. The threshold may be applied to a discrete value per frequency such that the parameter may be adjusted only for the specific frequency. In the example, where each discrete value falls below the threshold, the system 100, 100' may mute the microphone output signal entirely. That is, the values at these muted frequencies may be ignored for purposes of active noise cancellation through the adaptive filters.

The controller 105 may dynamically adjust the parameter linearly or non-linearly, proportional to the change in coherence. In one proportional output signal reduction example, if the coherence is found to be at 0.5, then the microphone output signal may adjust the gain similarly. For example, the cancellation signal output level may be reduced by 50%. By doing this, the coherence may be improved to 0.6. Then, upon the coherence improving to 0.6, the noise cancellation signal gain may be increased by 10%. The coherence may then fall above the example coherence threshold of 0.71. In this example, noise may be present on the microphone output signal that is changing over time. By reducing the output signal, the noise at the cancellation signals may also be reduced. As the noise on the microphone output signal changes, the parameters are updated to maintain the optimal level of cancellation and improve the coherence.

Further, while the controller 105 may initially adjust the parameter linearly, the controller 105 may subsequently adjust the parameter non-linearly to accommodate for change, or lack of change, in the coherence. For example, if the coherence fails to increase after several linear adjustments, the controller 105 may apply a non-linear adjustment to affect the coherence.

In another example, the controller 105 may dynamically update the parameter step size. In this example, the multiple coherence between each of the input sensors 110 to each of the output sensors 145 may be analyzed at a given frequency. If each of the multiple coherence for the input sensor 110 and output sensors 145*a*, 145*b* at a given frequency is 65%, the step size may be increased or decreased, for example, by 6%. If the coherence does not change as a result of the step size change, the step size may again be increased or decreased until the coherence threshold is met or until the counter/timer limits are met. That is, the controller 105 may mute or disregard the frequencies within the cancellation signals for all transducers if the counter/timer limits are exceeded.

In practice, if the step size does not change, and if the counter/time limits have not been met, a leakage parameter may also be updated in an effort to improve the coherence. In this example, an environmental change on the input signal may result in poorer coherence and thus cause the coherence to fall below the threshold. To ensure cancellation is optimal, the leakage parameter may be updated to compensate for the input signal change. The improved alignment of the cancellation signals and primary noises may result in a lower residual error in the output sensors, and would likely improve coherence.

In yet another example, parameters may dynamically be updated to adjust their weighting. A weighting parameter may be the amount weight that a microphone output signal for a specific transducer 140, or a set of transducers, is given as compared to other output signals from other transducers. In response to a high coherence for a given frequency, for example, 65%, the weighting parameter may be increased or decreased by a certain amount, for example 6%. If the coherence does not improve upon adjusting the weighting parameter, the weighting parameter of other output signals from other transducers may be dynamically adjusted. By doing this, the contributions from the transducers that have low coherences may be lowered and the contributions from the transducers with higher quality output signals may be increased. This may be the case when noise recognized at the input sensors 110 or output sensors 145 is coupled with poor natural responses between a given set of transducers and the output sensor 145. In an effort to not exacerbate the noise that already exists, contributions from the transducers that have a poor response may be dynamically decreased by the controller 105. By adjusting parameter weighting, the level of noise cancellation may be optimized.

Adjustments to the weighting parameters may be made in response to a partial coherence between the input sensor 110 and the output sensor 145. Furthermore, adjustments may be made in response to a partial coherence between a plurality of output sensors 145*a*, 145*b*. In this latter example, a plurality of output sensors 145*a*, 145*b* may be arranged in the same zone of the vehicle but one may have a significantly poorer response, thus, driving down the coherence.

The above adjustments are exemplary, and other adjustments may be made based on the coherence value.

Figure 4B:
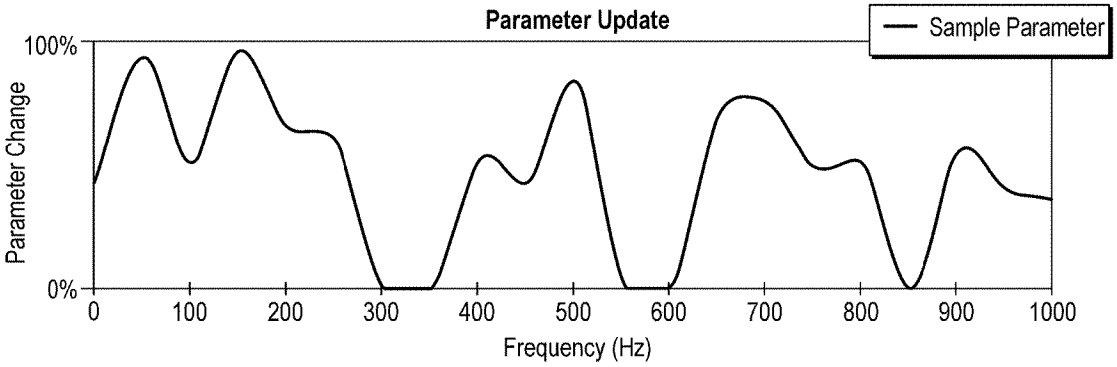
FIG. 4B illustrates an example chart of parameter changes over frequency.

FIG. 4B illustrates an example chart of parameter changes over frequency. As shown by way of example, the parameters may be dynamically updated when the coherence falls below the coherence threshold. In examples where the coherence is above the coherence threshold, e.g., as approximately 300 Hz, 580 Hz, and 850 Hz, the parameters may remain unchanged. The amount of change of these parameters at the respective frequencies having a coherence above the coherence threshold may be set to 0%. Other analog and/or digital adjustments may be made to the parameters associated with frequencies having a coherence falling below the coherence threshold.

Figure 5:
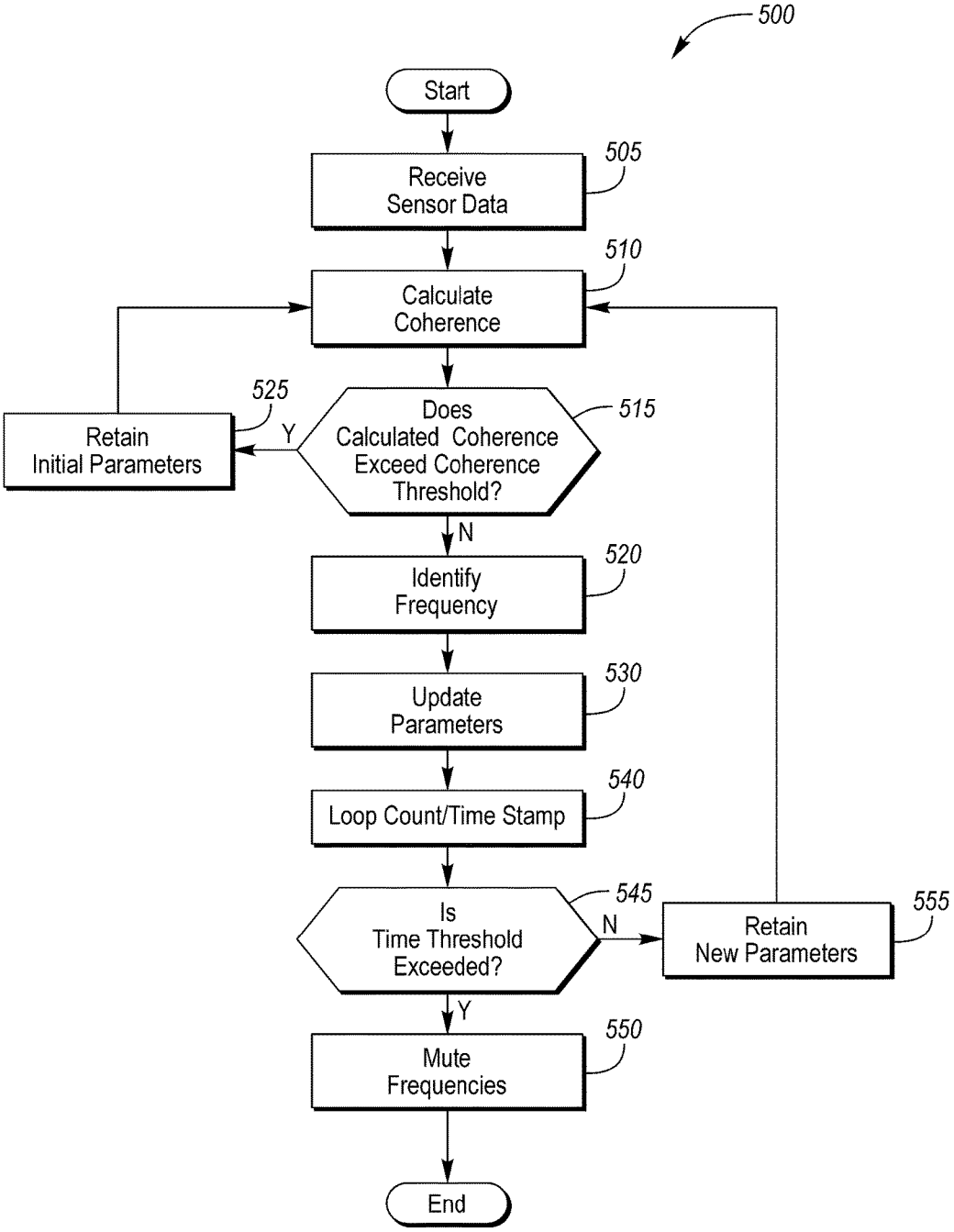
FIG. 5 illustrates an example process for the stability control system.

FIG. 5 illustrates an example process 500 for the stability control system 100, 100'. The controller 105 may be configured to perform the process 500, though a separate controller, processor, computing device, etc., may also be included to perform the process 500.

The process 500 may begin at block 505 where the controller 105 may receive sensor data via the input signal from the input sensor 110 and/or the microphone output signal from the output sensor 145. As explained above, the sensor data may include sensor data from the input signal received from the input sensor 110 indicative of an acceleration or motion. The sensor data may also include an output sensor data from the microphone output signal or microphone signal received from the output sensor 145 indicative of primary noise and the noise signal from the transducer 140.

At block 510, the controller 105 may determine a coherence based on the sensor data. For example, the coherence may be a partial or multiple coherence used to examine a relationship between the acceleration signal and the microphone signal. This is described above with respect to FIGS. 2 and 3. The coherence may be the coherence between an input sensor 110 and an output sensor 145, or the coherence between multiple output sensors 145*a*, 145*b*.

At block 515, the controller 105 may determine whether the coherence exceeds the coherence threshold. The coherence threshold may correspond to a potential noise reduction of 3 dB. 3 dB may be chosen, at least in part, due to values being less than 3 dB not being a perceptible change. Thus, the coherence threshold may be approximately 0.71. However, higher or lower thresholds may be used based on a specific system or desired output. If the coherence is at or below the coherence threshold, the process 500 proceeds to block 520. If the coherence threshold is exceeded, the process 500 proceeds to block 525.

At block 520, in response to the coherence not exceeding, or falling below the coherence threshold, the controller may identify the frequency for which the coherence is below the threshold. As explained above, threshold is applied to a discrete coherence value per frequency.

At block 530, the controller may dynamically update the output parameters associated with the identified frequency. The parameter may change the microphone output signal for noise cancellation.

At block 540, the controller 105 may maintain a time value based that is initiated at system start-up. The time value may include a count value incremented by a loop counter each time the coherence value is determined. The time value may additionally or alternatively include a clock time indicative of the time since the system start-up. The count value may be an integer value while the clock time may maintain a running clock time in milliseconds.

At block 545, the controller 105 may determine whether a predetermined time threshold is exceeded. The time threshold may maintain an integer value and/or a time value. If the count value or clock time of block 540 exceeds the time threshold, the process 500 proceeds to block 550. If the count value or clock time does not exceed the time threshold, the process 500 proceeds to block 555.

At block 550, in response to the time threshold being exceeded, the controller 105 may instruct the microphone output signal to be muted (e.g., exclude the microphone output signal from affecting any parameter updates). In this example, the coherence at a certain frequency may be considered to be unstable for a long length of time (e.g., exceeds the time threshold).

At block 555, in response to the time threshold not being exceeded, the controller 105 retains the updated parameters and stores them in the database 130. The updated parameters are then used to generate the noise cancellation signal and the process 500 then proceeds back to block 510.

Accordingly, a stability system is described herein wherein a coherence between a reference signal and a feedback signal is used to identify instabilities or artifacts coming from the audio system of a vehicle. Such instabilities may affect the performance of the ARNC system. In some situations, if the coherence drops below a predefined threshold, the stability system will reduce speaker output. In other situations, the stability system may shut off or mute the output signals in response to the coherence being classified as unstable for a period of time. This may be helpful when one of the sensors is covered (e.g., the microphone), or when wind noise is recognized.

While road noise and structural noise are described herein, the stability system may also be applied to engine harmonic cancellation, airborne noises, aeroacoustics, fan, component level noise, etc. Furthermore, the system, while described with respect to a vehicle, may also be applicable to other situations, products and scenarios. In the examples discussed herein, the coherence may be calculated or estimated in an effort to reduce processing times.

The embodiments of the present disclosure generally provide for a plurality of circuits, electrical devices, and at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any controller as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any controller as disclosed utilizes any one or more microprocessors to execute a computer-program that is embodied in a non-transitory computer readable medium that is programmed to perform any number of the functions as disclosed. Further, any controller as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware based inputs and outputs for receiving and transmitting data, respectively from and to other hardware based devices as discussed herein.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A coherence based dynamic stability control system for a vehicle audio system, comprising:

at least one output sensor configured to transmit an output signal including a noise cancellation signal and an undesired noise signal;

at least one input sensor configured to transmit an input signal indicative of an acceleration of a vehicle; and a processor being programmed to:

control a transducer to output the noise cancellation signal based on at least one parameter;

receive the input signal and the output signal;

determine a coherence between the input signal and the output signal;

determine whether the coherence exceeds a predefined coherence threshold;

adjust the at least one parameter to generate an adjusted parameter; and control the transducer to output an updated noise cancellation signal based on the adjusted parameter in response to the coherence failing to exceed the predefined coherence threshold.

2. The system of claim 1, wherein the adjusted parameter is iteratively updated based on the coherence until the coherence exceeds the predefined coherence threshold.

3. The system of claim 2, wherein the adjusted parameter includes a gain of the noise cancellation signal, and wherein the processor is further programmed to reduce the gain to reduce noise present at the noise cancellation signal.

4. The system of claim 2, wherein the adjusted parameter includes a leakage parameter.

5. The system of claim 2, wherein the adjusted parameter includes a step size, and wherein the processor is further programmed to increase or decrease the step size.

6. The system of claim 1, wherein the processor is further programmed to determine whether a time since receiving the output signal exceeds a predetermined time threshold.

7. The system of claim 6, wherein the processor is further programmed to generate the noise cancellation signal without adjusting the at least one parameter based on the output signal.

8. The system of claim 6, wherein the processor is further programmed to store the adjusted parameter and generate the noise cancellation signal based on the adjusted parameter.

9. A method for performing dynamic stability control for a vehicle audio system, comprising:

controlling a transducer to output a noise cancellation signal based on at least one default parameter;

receiving at least one reference signal and feedback signal;

determining a coherence between the reference signal and feedback signal;

determining whether the coherence exceeds a predefined coherence threshold;

generating at least one updated parameter by dynamically adjusting the at least one default parameter; and providing an updated noise cancellation signal based on the at least one updated parameter in response to the coherence failing to exceed the predefined coherence threshold.

10. The method of claim 9, wherein the at least one updated parameter is iteratively updated based on the coherence until the coherence exceeds the predefined coherence threshold.

11. The method of claim 10, wherein the at least one updated parameter includes a gain of the noise cancellation signal, and further comprising reducing the gain to reduce noise present at the noise cancellation signal.

12. The method of claim 10, wherein the at least one updated parameter includes a leakage parameter.

13. The method of claim 10, wherein the at least one updated parameter includes a step size, and further comprising increasing the step size to increase the coherence.

14. The method of claim 9, further comprising determining whether a time since receiving the feedback signal exceeds a predetermined time threshold.

15. The method of claim 14, further comprising generating the noise cancellation signal without updating the at least one parameter based on the feedback signal.

16. The method of claim 14, further comprising storing the at least one updated parameter and generating the noise cancellation signal based on the at least one updated parameter.

17. A coherence based dynamic stability control system for a vehicle audio system, comprising:

a transducer, and a processor coupled to the transducer, the processor programmed to:

control the transducer to output a noise cancellation signal based on at least on default parameter;

receive at least two signals;

determine a coherence between the two signals;

determine whether the coherence exceeds a predefined coherence threshold;

generate at least one updated parameter by dynamically adjusting the at least one default parameter; and providing an updated noise cancellation signal based on the at least one updated parameter in response to the coherence failing to exceed the predefined coherence threshold.

18. The system of claim 17, wherein the at least one updated parameter is iteratively updated based on the coherence until the coherence exceeds the predefined coherence threshold.

19. The system of claim 18, wherein the at least one updated parameter includes a gain of the noise cancellation signal, and wherein the processor is further programmed to reduce the gain to reduce noise present at the noise cancellation signal.

20. The system of claim 17, wherein the processor is further programmed to determine whether a time since receiving the signals exceeds a predetermined time threshold and generate the noise cancellation signal without updating the at least one parameter based on the feedback signal.

* * * * *